US007694897B2

(12) United States Patent
Bulan et al.

(10) Patent No.: US 7,694,897 B2
(45) Date of Patent: Apr. 13, 2010

(54) INTEGRATED MULTI-FUNCTION SHOWERHEAD

(75) Inventors: Jamy Bulan, Lakewood, OH (US); James F. Dempsey, North Olmsted, OH (US); Timothy John O'Brien, Shaker Heights, OH (US); Harshil Parikh, North Olmsted, OH (US)

(73) Assignee: Moen Incorporated, North Olmsted, OH (US)

( * ) Notice: Subject to any disclaimer, the term of this patent is extended or adjusted under 35 U.S.C. 154(b) by 194 days.

(21) Appl. No.: 11/788,086

(22) Filed: Apr. 19, 2007

(65) Prior Publication Data

US 2007/0246578 A1 Oct. 25, 2007

Related U.S. Application Data

(60) Provisional application No. 60/793,872, filed on Apr. 20, 2006.

(51) Int. Cl.

| | |
|---|---|
| ***B05B 1/14*** | (2006.01) |
| ***A62C 31/00*** | (2006.01) |
| ***A62C 2/08*** | (2006.01) |
| ***A62C 37/08*** | (2006.01) |
| ***E21F 5/04*** | (2006.01) |
| ***F23D 11/38*** | (2006.01) |
| ***F23D 14/48*** | (2006.01) |
| ***A62C 37/20*** | (2006.01) |

(52) U.S. Cl. ..... 239/556; 239/558; 239/436; 239/548; 239/563

(58) Field of Classification Search ..... 239/558, 239/390–397, 442–444, 447, 539, 557, 567, 239/559–562, 17

See application file for complete search history.

(56) References Cited

U.S. PATENT DOCUMENTS

| | | | |
|---|---|---|---|
| 1,958,038 | A | 5/1934 | Fraser |
| 2,024,510 | A | 12/1935 | Crisenberry |
| 3,008,652 | A | 11/1961 | McLean |
| 4,302,040 | A | 11/1981 | Lazar |
| 4,413,362 | A | 11/1983 | Chianco et al. |
| D349,947 | S | 8/1994 | Hing-Wah |
| D374,273 | S | 10/1996 | Chan |
| D379,212 | S | 5/1997 | Chan |
| D385,616 | S | 10/1997 | Dow et al. |
| D392,369 | S | 3/1998 | Chan |
| D394,897 | S | 6/1998 | Chan |
| D415,821 | S | 10/1999 | Milrud et al. |
| D417,257 | S | 11/1999 | Milrud |

(Continued)

*Primary Examiner*—Dinh Q Nguyen
*Assistant Examiner*—Justin Jonaitis
(74) *Attorney, Agent, or Firm*—Calfee, Halter & Griswold LLP

(57) ABSTRACT

A showerhead has at least a first set of nozzles and a second set of nozzles for discharging water. The showerhead discharges water according to one of multiple water delivery functions, where a first water delivery function corresponds to water being discharged through only the first set of nozzles, a second water delivery function corresponds to water being discharged through only the second set of nozzles and a third water delivery function corresponds to water being discharged through the first and second sets of nozzles simultaneously. The spacing between the first set of nozzles and the second set of nozzles is carefully selected so that the third water delivery function corresponds to the integrated nozzles of the first and second sets of nozzles. As a result, the third water delivery function provides a coherent and balanced water flow resulting in a more pleasant feel.

23 Claims, 9 Drawing Sheets

U.S. PATENT DOCUMENTS

| | | | | | |
|---|---|---|---|---|---|
| D424,164 | S | | 5/2000 | Haug et al. | |
| D429,795 | S | | 8/2000 | Tse | |
| D430,265 | S | | 8/2000 | Tse | |
| D432,210 | S | * | 10/2000 | Tse | D23/229 |
| D432,211 | S | | 10/2000 | Chan | |
| D432,625 | S | | 10/2000 | Chan | |
| D439,305 | S | | 3/2001 | Slothower | |
| D440,276 | S | | 4/2001 | Slothower | |
| D440,277 | S | | 4/2001 | Slothower | |
| D440,278 | S | | 4/2001 | Slothower | |
| D443,026 | S | | 5/2001 | Kollmann et al. | |
| 6,230,989 | B1 | | 5/2001 | Haverstraw et al. | |
| D450,372 | S | | 11/2001 | Christianson | |
| D451,170 | S | | 11/2001 | Lindholm et al. | |
| D452,897 | S | | 1/2002 | Gillette et al. | |
| D457,937 | S | | 5/2002 | Lindholm et al. | |
| D459,437 | S | | 6/2002 | Christianson | |
| 6,412,125 | B1 | | 7/2002 | Ito et al. | |
| 6,412,711 | B1 | * | 7/2002 | Fan | 239/446 |
| 6,454,186 | B2 | | 9/2002 | Haverstraw et al. | |
| D477,652 | S | | 7/2003 | Itoh | |
| 6,641,057 | B2 | | 11/2003 | Thomas et al. | |
| D483,838 | S | | 12/2003 | Haug et al. | |
| D485,887 | S | * | 1/2004 | Luettgen et al. | D23/223 |
| D487,301 | S | * | 3/2004 | Haug et al. | D23/229 |
| D489,793 | S | | 5/2004 | Haug et al. | |
| 6,736,336 | B2 | | 5/2004 | Wong | |
| 6,739,523 | B2 | | 5/2004 | Haverstraw et al. | |
| D495,027 | S | | 8/2004 | Mazzola | |
| D498,514 | S | * | 11/2004 | Haug et al. | D23/223 |
| D510,610 | S | | 10/2005 | Bailey et al. | |
| D546,413 | S | * | 7/2007 | Sedwick | D23/213 |
| 7,374,112 | B1 | * | 5/2008 | Bulan et al. | 239/556 |
| 2002/0116758 | A1 | | 8/2002 | Ito et al. | |
| 2002/0124307 | A1 | | 9/2002 | Ito et al. | |
| 2003/0204904 | A1 | | 11/2003 | Ito et al. | |
| 2005/0001072 | A1 | * | 1/2005 | Bolus et al. | 239/548 |
| 2005/0061896 | A1 | | 3/2005 | Luettgen et al. | |

* cited by examiner

INTEGRATED MULTI-FUNCTION SHOWERHEAD

RELATED APPLICATION

The present application is being filed as a non-provisional patent application claiming priority/benefit under 35 U.S.C. § 119(e) from U.S. Provisional Patent Application No. 60/793,872 filed on Apr. 20, 2006, which is incorporated herein by reference.

FIELD

The invention relates generally to showerheads and, more particularly, to multi-function showerheads.

BACKGROUND

Multi-function showerheads are known in which different sets of nozzles provide different water delivery functions, such that a user can select between the different water delivery functions. Water is discharged from the multi-function showerhead differently for each of the water delivery functions so that the user experiences a desired sensation corresponding to the selected water delivery function. The water delivery functions can include, for example, a stream function, a spray function, a pulse function, and variations thereof. The different water delivery functions can be provided by varying the number of nozzles, the size of openings of the nozzles and the like, in each of the sets of nozzles.

Furthermore, it is known that by using more than one set of nozzles simultaneously, a combined water delivery function can be provided. However, because the nozzles corresponding to the individual water delivery functions are spaced apart from one another and are intended to provide noticeably distinct sensations to the user upon being selected, the formation of the combined water delivery function as the combination of these nozzles results in water being discharged from the showerhead having an incoherent and unbalanced spray pattern, which can result in an unpleasant sensation for the user.

SUMMARY

In view of the above, a multi-function apparatus is provided that includes at least a first set of nozzles and a second set of nozzles. The apparatus discharges a fluid according to a fluid delivery function selected from at least a first fluid delivery function, a second fluid delivery function and a third fluid delivery function. The first fluid delivery function corresponds to the fluid being discharged through only the first set of nozzles, the second fluid delivery function corresponds to the fluid being discharged through only the second set of nozzles and the third fluid delivery function corresponds to the fluid being discharged through the first and second sets of nozzles simultaneously.

As described herein, the spatial arrangement of the nozzles, the number of nozzles and/or the size of the nozzles in each of the first and second sets of nozzles is carefully selected so that the first fluid delivery function and the second fluid delivery function are closely integrated. As a result, the third fluid delivery function provides a relatively coherent and balanced spray pattern, which can result in a pleasant sensation for the user.

Numerous advantages and features will become readily apparent from the following detailed description of exemplary embodiments, from the claims and from the accompanying drawings.

BRIEF DESCRIPTION OF THE DRAWINGS

The invention as well as embodiments and advantages thereof are described below in greater detail, by way of example, with reference to the drawings wherein like reference numbers denote like elements and in which.

DETAILED DESCRIPTION

Figure 1:
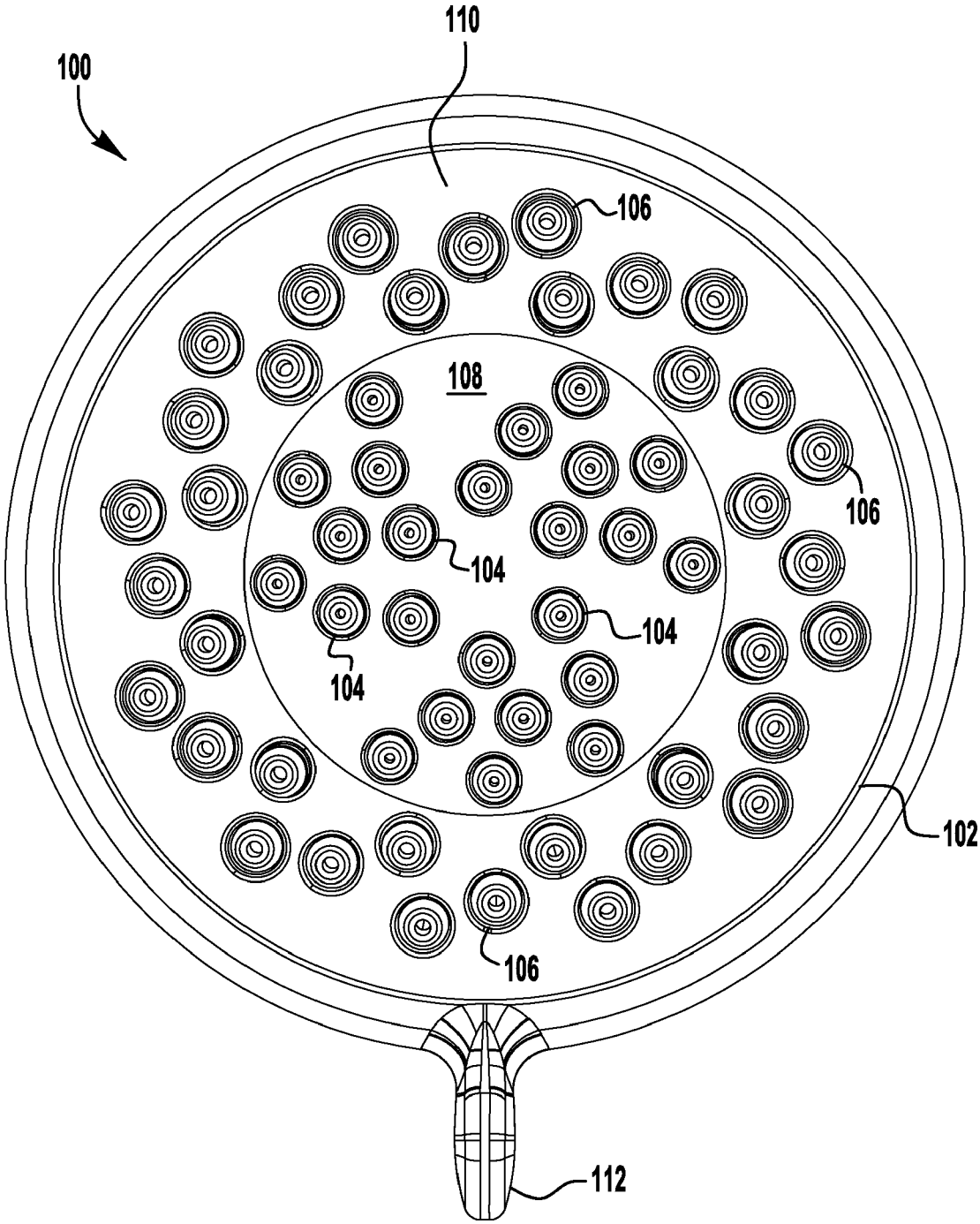
FIG. 1 is a diagram of a three-function showerhead according to an exemplary embodiment.

While the general inventive concept is susceptible of embodiment in many different forms, there are shown in the drawings and will be described herein in detail specific embodiments thereof with the understanding that the present disclosure is to be considered as an exemplification of the principles of the general inventive concept. Accordingly, the general inventive concept is not intended to be limited to the specific embodiments illustrated herein.

A multi-function showerhead according to an exemplary embodiment is shown as a three-function showerhead 100 (hereinafter, the "showerhead 100") in FIGS. 1-4. The showerhead 100 includes a face 102 in which a plurality of nozzles 104, 106 are disposed. For purposes of illustration, only a few of the nozzles 104, 106 are labeled in the drawings. In one exemplary embodiment, the nozzles 104, 106 extend through corresponding openings in the face 102.

The nozzles 104, 106 are arranged such that a first set of nozzles 108 occupies an inner region of the face 102 and a second set of nozzles 110 occupies an outer region of the face 102. Thus, the first set of nozzles 108 is surrounded/enclosed by the second set of nozzles 110. The first set of nozzles 108 corresponds to a first water delivery function and the second set of nozzles 110 corresponds to a second water delivery function. For example, the first water delivery function can provide a stream of water from the showerhead 100 and the second water delivery function can provide a spray of water from the showerhead 100.

Additionally, a third water delivery function is provided which uses both the first set of nozzles 108 and the second set of nozzles 110 simultaneously. The showerhead 100 includes a grip 112 which allows the user to select one of the three water delivery functions provided by the showerhead 100.

By integrating the first set of nozzles 108 and the second set of nozzles 110, the third water delivery function, which uses both sets of nozzles 108 and 110 simultaneously, is operable to discharge water in a more coherent and balanced manner resulting in an improved showering experience. For example, the distance (or spacing) between the first set of nozzles 108 and the second set of nozzles 110 is relatively small, such that the first set of nozzles 108 and the second set of nozzles 110 are integrated. Furthermore, the number of nozzles in each of the first set of nozzles 108 and the second set of nozzles 110, as well as a corresponding total cross-sectional area (i.e., flow area) of the openings of the first set of nozzles 108 and the second set of nozzles 110, can contribute to the integration of the first set of nozzles 108 and the second set of nozzles 110.

In one exemplary embodiment, the first set of nozzles 108 has at least 9 nozzles 104 and the second set of nozzles 110 has at least 9 nozzles 106. As shown in FIGS. 1-4, the showerhead 100 has 24 nozzles 104 in the first set of nozzles 108 and 36 nozzles 106 in the second set of nozzles 110. The nozzles 104 in the first set of nozzles 108 may or may not have the same dimensions. The nozzles 106 in the second set of nozzles 110 may or may not have the same dimensions. The nozzles 104, 106 in both the first set of nozzles 108 and the second set of nozzles 110 may or may not have the same dimensions.

In one exemplary embodiment, a diameter of an opening in each nozzle 104 in the first set of nozzles 108 is within 0.032 inches to 0.042 inches, inclusive. In another exemplary embodiment, a diameter of an opening in each nozzle 104 in the first set of nozzles 108 is within 0.036 inches to 0.046 inches, inclusive. In yet another exemplary embodiment, a diameter of an opening in each nozzle 104 in the first set of nozzles 108 is within 0.028 inches to 0.038 inches, inclusive. In still another exemplary embodiment, a diameter of an opening in each nozzle 104 in the first set of nozzles 108 is within 0.030 inches to 0.040 inches, inclusive.

In one exemplary embodiment, a diameter of an opening in each nozzle 104 in the first set of nozzles 108 is approximately equal to 0.034 inches. In another exemplary embodiment, a diameter of an opening in each nozzle 104 in the first set of nozzles 108 is approximately equal to 0.042 inches. In yet another exemplary embodiment, a diameter of an opening in each nozzle 104 in the first set of nozzles 108 is approximately equal to 0.030 inches. In still another exemplary embodiment, a diameter of an opening in each nozzle 104 in the first set of nozzles 108 is approximately equal to 0.040 inches.

In one exemplary embodiment, a diameter of an opening in each nozzle 106 in the second set of nozzles 110 is within 0.028 inches to 0.038 inches, inclusive. In another exemplary embodiment, a diameter of an opening in each nozzle 106 in the second set of nozzles 110 is within 0.020 inches to 0.032 inches, inclusive. In yet another exemplary embodiment, a diameter of an opening in each nozzle 106 in the second set of nozzles 110 is within 0.032 inches to 0.042 inches, inclusive. In still another exemplary embodiment, a diameter of an opening in each nozzle 106 in the second set of nozzles 110 is within 0.028 inches to 0.035 inches, inclusive.

In one exemplary embodiment, a diameter of an opening in each nozzle 106 in the second set of nozzles 110 is approximately equal to 0.034 inches. In another exemplary embodiment, a diameter of an opening in each nozzle 106 in the second set of nozzles 110 is approximately equal to 0.032 inches. In yet another exemplary embodiment, a diameter of an opening in each nozzle 106 in the second set of nozzles 110 is approximately equal to 0.038 inches. In still another exemplary embodiment, a diameter of an opening in each nozzle 106 in the second set of nozzles 110 is approximately equal to 0.035 inches.

In one exemplary embodiment, the first set of nozzles 108 has from 15 to 45 nozzles 104, inclusive, with a total cross-sectional area of the openings of the nozzles 108 being within 0.010 $in^2$ to 0.045 $in^2$, inclusive. In another exemplary embodiment, the first set of nozzles 108 has from 19 to 42 nozzles 104, inclusive, with a total cross-sectional area of the openings of the nozzles 108 being within 0.015 $in^2$ to 0.040 $in^2$, inclusive. In yet another exemplary embodiment, the first set of nozzles 108 has from 22 to 38 nozzles 104, inclusive, with a total cross-sectional area of the openings of the nozzles 108 being within 0.018 $in^2$ to 0.037 $in^2$, inclusive. In still another exemplary embodiment, the first set of nozzles 108 has from 24 to 36 nozzles 104, inclusive, with a total cross-sectional area of the openings of the nozzles 108 being within 0.019 $in^2$ to 0.041 $in^2$, inclusive.

In one exemplary embodiment, the first set of nozzles 108 has 24 nozzles 104 with a total cross-sectional area of the openings of the nozzles 108 being approximately 0.022 $in^2$. In another exemplary embodiment, the first set of nozzles 108 has 24 nozzles 104 with a total cross-sectional area of the openings of the nozzles 108 being approximately 0.033 $in^2$. In yet another exemplary embodiment, the first set of nozzles 108 has 36 nozzles 104 with a total cross-sectional area of the openings of the nozzles 108 being approximately 0.025 $in^2$. In still another exemplary embodiment, the first set of nozzles 108 has 30 nozzles 104 with a total cross-sectional area of the openings of the nozzles 108 being approximately 0.038 $in^2$.

In one exemplary embodiment, the second set of nozzles 110 has from 20 to 90 nozzles 106, inclusive, with a total cross-sectional area of the openings of the nozzles 110 being within 0.010 $in^2$ to 0.080 $in^2$, inclusive. In another exemplary embodiment, the second set of nozzles 110 has from 23 to 70 nozzles 106, inclusive, with a total cross-sectional area of the openings of the nozzles 110 being within 0.012 $in^2$ to 0.060 $in^2$, inclusive. In yet another exemplary embodiment, the second set of nozzles 110 has from 25 to 65 nozzles 106, inclusive, with a total cross-sectional area of the openings of the nozzles 110 being within 0.018 $in^2$ to 0.053 $in^2$, inclusive. In still another exemplary embodiment, the second set of nozzles 110 has from 27 to 70 nozzles 106, inclusive, with a total cross-sectional area of the openings of the nozzles 110 being within 0.020 $in^2$ to 0.067 $in^2$, inclusive.

In one exemplary embodiment, the second set of nozzles 110 has 36 nozzles 106 with a total cross-sectional area of the openings of the nozzles 110 being approximately 0.033 $in^2$. In another exemplary embodiment, the second set of nozzles 110 has 64 nozzles 106 with a total cross-sectional area of the openings of the nozzles 110 being approximately 0.051 $in^2$. In yet another exemplary embodiment, the second set of nozzles 110 has 27 nozzles 106 with a total cross-sectional area of the openings of the nozzles 110 being approximately 0.031 $in^2$. In still another exemplary embodiment, the second set of nozzles 110 has 70 nozzles 106 with a total cross-sectional area of the openings of the nozzles 110 being approximately 0.067 $in^2$.

The nozzle characteristics described herein (e.g., diameter of the openings and total cross-sectional area of the openings) are based on nozzles (e.g., nozzles 104 and 106) having substantially circular openings. It will be appreciated that the general inventive concept encompasses other nozzle types, including nozzles having non-circular openings. The equivalent nozzle characteristics of a nozzle having a non-circular opening can be readily determined.

Figure 2:
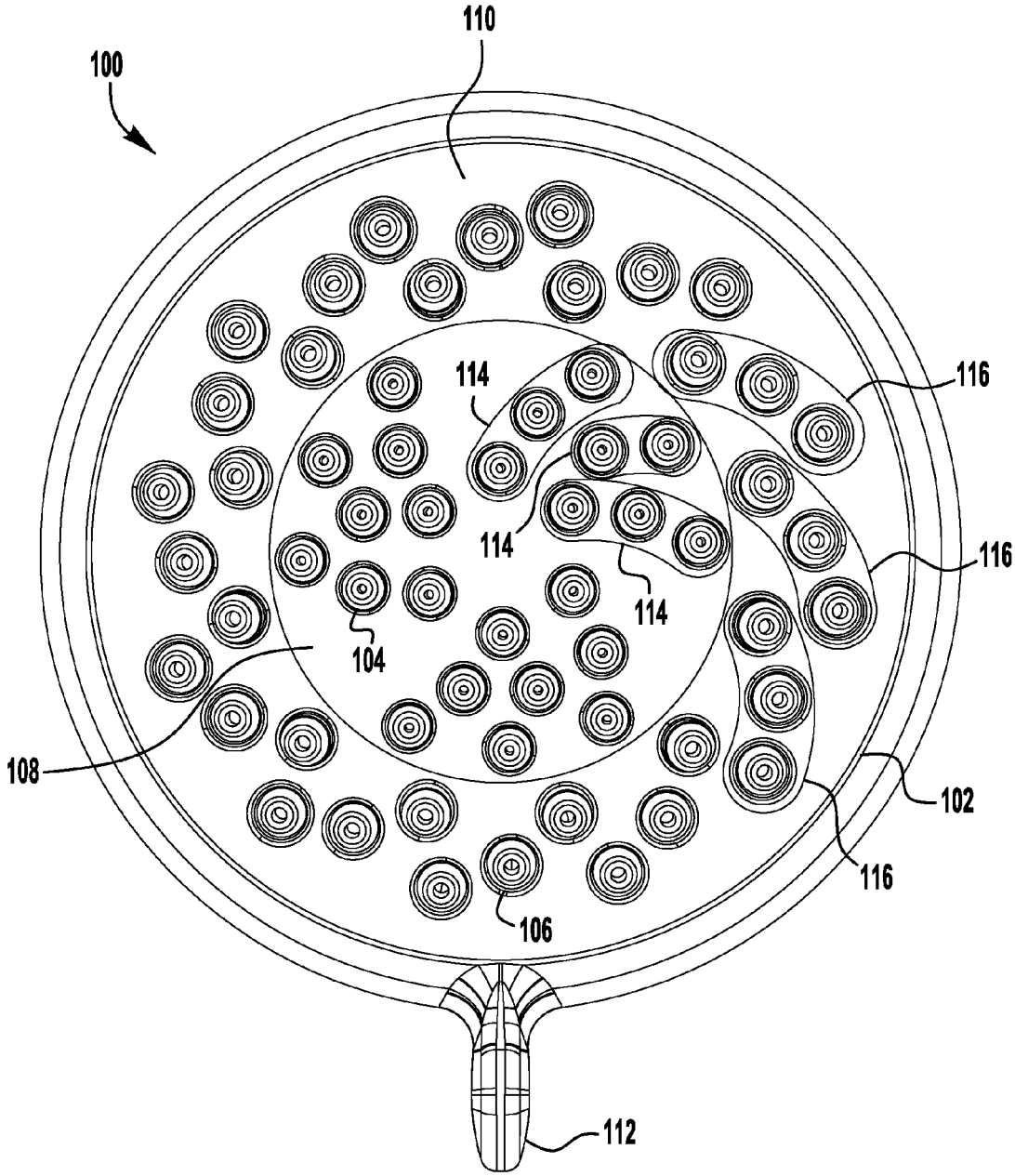
FIG. 2 is a diagram showing nozzle groupings forming exemplary first and second curves in the showerhead of FIG. 1.

As shown in FIG. 2, the first set of nozzles 108 includes a plurality of first curves 114 which are each formed from a plurality of adjacent nozzles 104. The second set of nozzles 110 includes a plurality of second curves 116 which are each formed from a plurality of adjacent nozzles 106. For purposes of illustration, the nozzles 104 forming a few of the first curves 114 and the nozzles 110 forming a few of the second curves 116 are surrounded by a geometric shape. As used herein, a "curve" refers to a line connecting a set of points, wherein the points may be represented by openings of nozzles on a face of a showerhead. For example, the points may be represented by the openings of the nozzles 104, 106 on the face 102 of the showerhead 100. The line may or may not be a straight line. The line may or may not have a constant rate of curvature. Accordingly, the first curves and/or the second curves can be linear or non-linear.

Each first curve 114 passes through a center of an opening in the plurality of nozzles forming the first curve 114. Each second curve 116 passes through a center of an opening in the plurality of nozzles forming the second curve 116. In one exemplary embodiment, at least one of the first curves 114 and the second curves 116 is formed from three or more nozzles 104 or 106, respectively.

Figure 3:
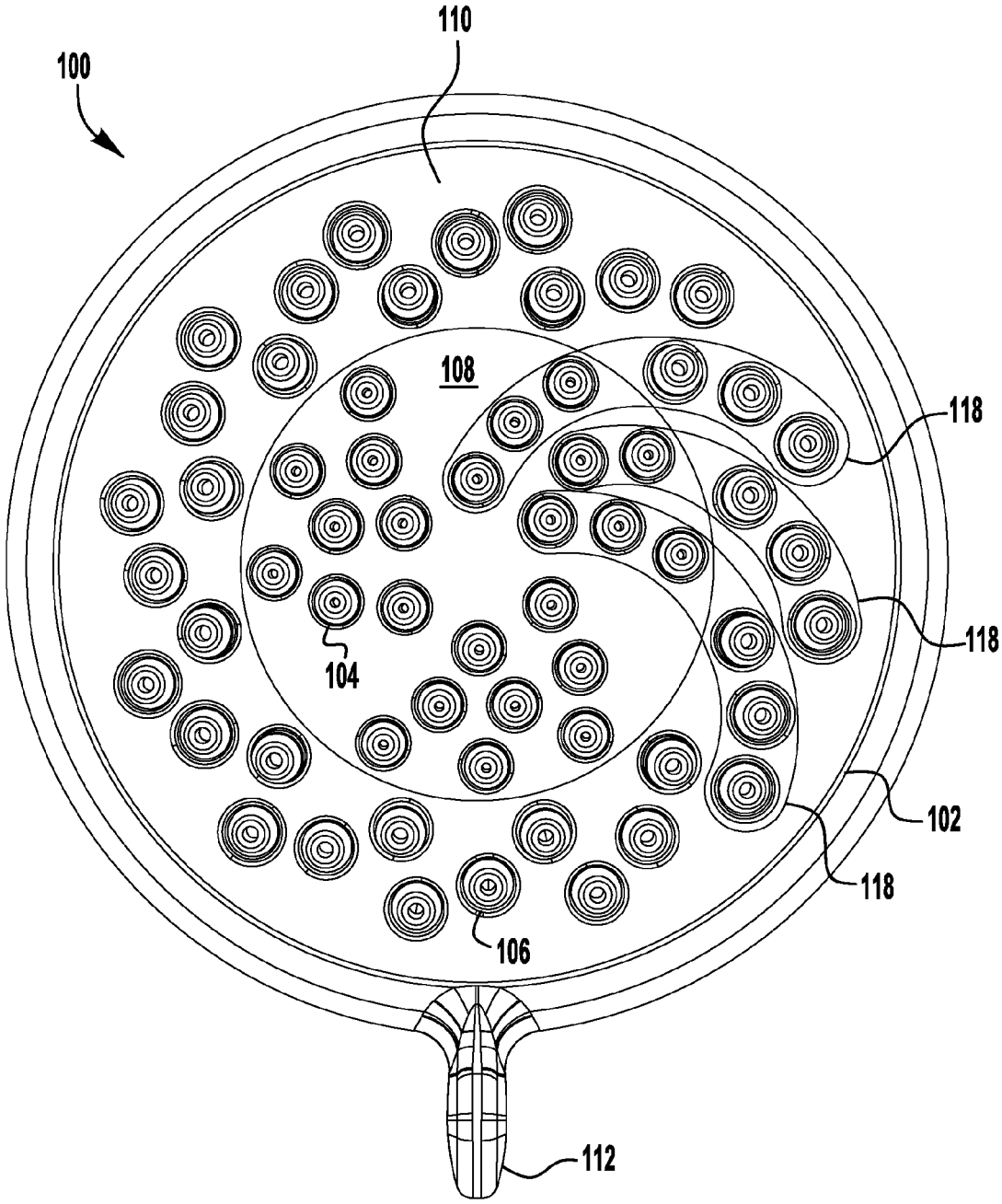
FIG. 3 is a diagram showing nozzle groupings forming exemplary third curves in the showerhead of FIG. 1.

In FIG. 2, the nozzles 104 in the first curve 114 form a first path that is substantially aligned with a second path of the nozzles 106 in the corresponding second curve 116. A plurality of the first curves 114 including nozzles 104 and the second curves 116 including nozzles 106 form third curves 118 including nozzles 104 and 106, as shown in FIG. 3. The third curves 118 are associated with the third water delivery function. As noted above, the nozzles 104, 106 in the third curves 118 are integrated. This means, for example, that the distance (or spacing) between the first set of nozzles 108 and the second set of nozzles 110 is relatively small. Furthermore, as noted above, the arrangement, number and/or size of the nozzles 104, 106 can be selected to facilitate the integration of the first set of nozzles 108 and the second set of nozzles 110.

Figure 4:
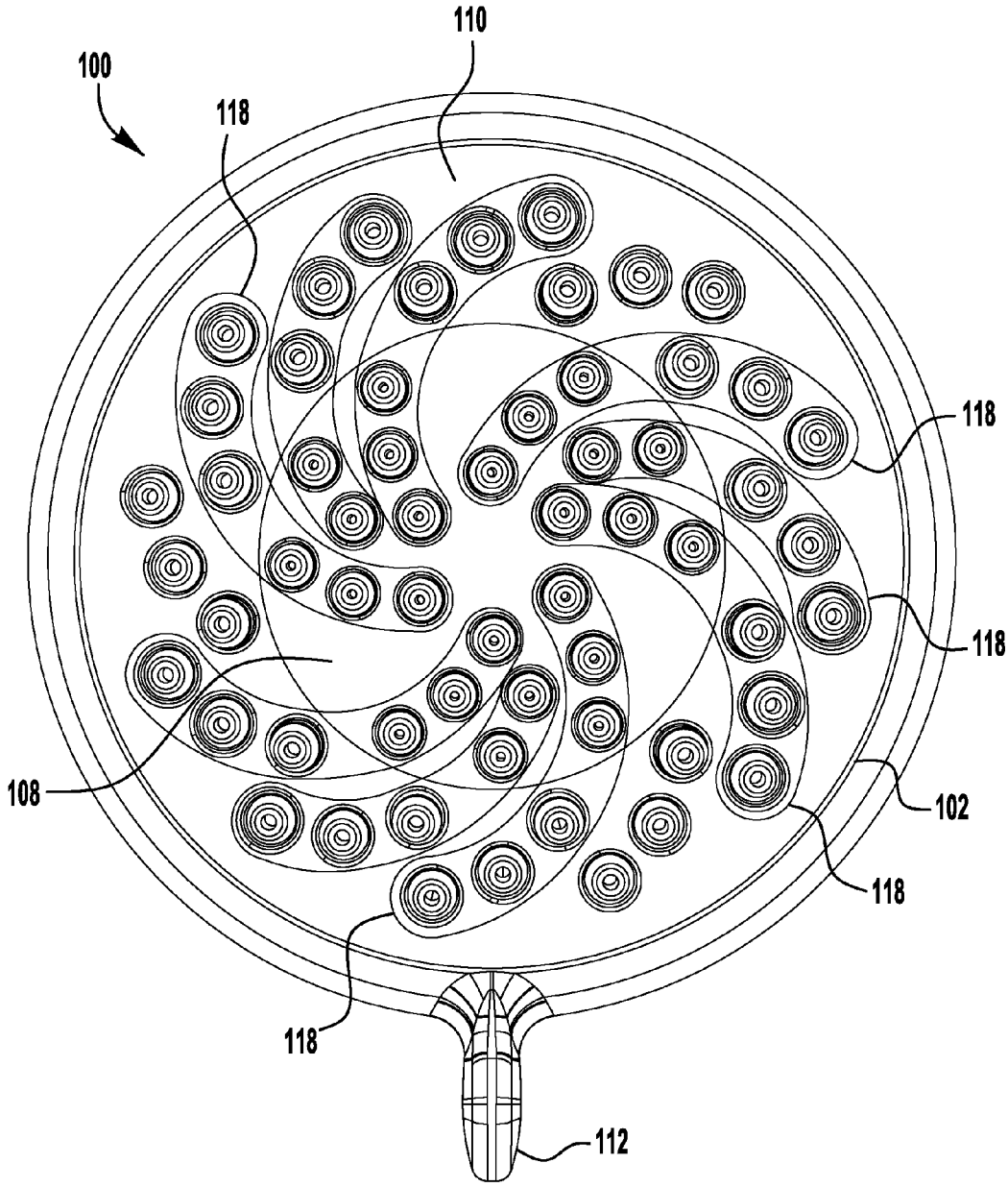
FIG. 4 is a diagram showing all of the exemplary third curves in the showerhead of FIG. 1.

In one exemplary embodiment, each first curve 114 is aligned with a corresponding second curve 116 to form a plurality of the third curves 118, as shown in FIG. 4.

Figure 5:
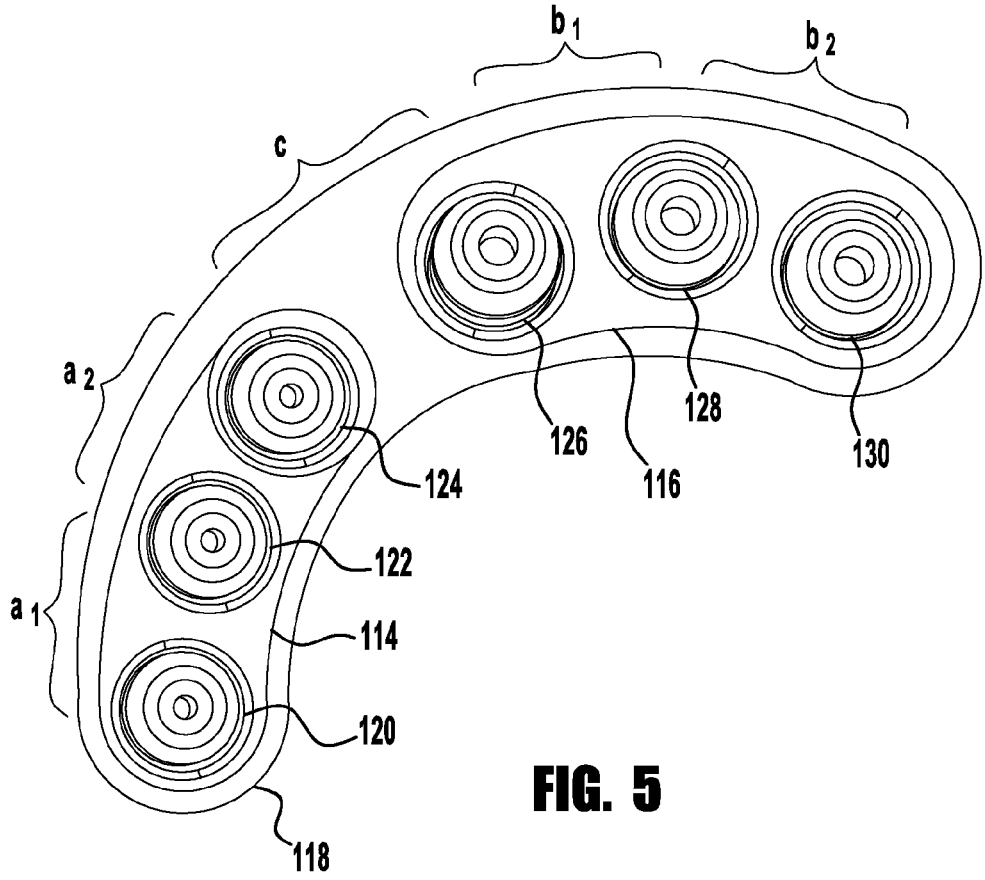
FIG. 5 is a diagram showing a close-up view of a single exemplary third curve of the showerhead of FIG. 1.

FIG. 5 shows a single third curve 118 from the showerhead 100. The third curve 118 is formed from the first curve 114 and the second curve 116. The first curve 114 contains nozzles 120, 122 and 124. The second curve 116 contains nozzles 126, 128 and 130.

A distance measured from a center of an opening of the nozzle 120 to a center of an opening of the nozzle 122 is denoted as $a_1$. A distance measured from a center of the opening of the nozzle 122 to a center of an opening of the nozzle 124 is denoted as $a_2$. The average distance (or spacing) between the center of the openings of the nozzles 120, 122 and 124 in the first curve 114 is denoted as $a_{avg}$ and can be computed from Equation 1.

$$a_{avg}=(a_1+a_2)/2 \quad \text{(Equation 1)}$$

A distance measured from a center of an opening of the nozzle 126 to a center of an opening of the nozzle 128 is denoted as $b_1$. A distance measured from a center of the opening of the nozzle 128 to a center of an opening of the nozzle 130 is denoted as $b_2$. The average distance (or spacing) between the center of the openings of the nozzles 126, 128 and 130 in the second curve 116 is denoted as $b_{avg}$ and can be computed from Equation 2.

$$b_{avg}=(b_1+b_2)/2 \quad \text{(Equation 2)}$$

A distance measured from a center of the opening of the nozzle 124 to a center of the opening of the nozzle 126 is denoted as c, which represents the distance (or spacing) between the center of the openings of the nozzles in the first and second curves 114, 116 (i.e., the first set of nozzles 108 and the second set of nozzles 110). To ensure the integration of the first set of nozzles 108 (including nozzles 120, 122 and 124) and the second set of nozzles 110 (including nozzles 126, 128 and 130), the value c is selected to satisfy the relationship shown in Equation 3. In Equation 3, the value x is a constant value that represents the magnitude of integration. In one exemplary embodiment, the value x is in the range of 2 to 5, inclusive. In Equation 3, min ($a_{avg}$, $b_{avg}$) means to substitute the smaller of the two values $a_{avg}$ and $b_{avg}$.

$$c \leqq x^*\min(a_{avg}, b_{avg}) \quad \text{(Equation 3)}$$

For example, with a value of x equals 5, the spacing between the first set of nozzles 108 and the second set of nozzles 110 must be less than five times the smaller of the average spacing between the nozzles 104 of the first curves 114 in the first set of nozzles 108 and the average spacing between the nozzles 106 of the second curves 116 in the second set of nozzles 110. With a value of x equals 2, the spacing between the first set of nozzles 108 and the second set of nozzles 110 must be less than two times the smaller of the average spacing between the nozzles 104 of the first curves 114 in the first set of nozzles 108 and the average spacing between the nozzles 106 of the second curves 116 in the second set of nozzles 110. As the value of x decreases, the integration between the first set of nozzles 108 and the second set of nozzles 110 is maximized.

The distance c between an adjacent first curve 114 and second curve 116 (i.e., a first third curve 118) may differ from the distance c between another adjacent first curve 114 and second curve 116 (i.e., a second third curve 118). Integration of the first set of nozzles 108 and the second set of nozzles 110 on the face 102 of the showerhead 100 can be based on the distance c of the plurality of third curves 118 on the face 102 of the showerhead 100.

In one exemplary embodiment, at least one of the third curves 118 has a value c that satisfies the relationship shown in Equation 3. In another exemplary embodiment, at least 50% of the third curves 118 have a value c that satisfies the relationship shown in Equation 3. In still another exemplary embodiment, all of the third curves 118 have a value c that satisfies the relationship shown in Equation 3.

A nozzle arrangement 200 according to another exemplary embodiment is shown in FIGS. 6-9. The nozzle arrangement 200 could be used, for example, on the three-function showerhead 100 shown in FIG. 1. The nozzle arrangement 200 includes a plurality of nozzles 202, 204 for discharging a fluid. For purposes of illustration, only a few of the nozzles 202, 204 are labeled in the drawings. In one exemplary embodiment, the nozzles are for discharging water.

The nozzles 202, 204 are arranged such that a first set of nozzles 206 occupies an inner region of the nozzle arrangement 200 and a second set of nozzles 208 occupies an outer region of the nozzle arrangement 200. Thus, the first set of nozzles 206 is surrounded/enclosed by the second set of nozzles 208. The first set of nozzles 206 corresponds to a first water delivery function and the second set of nozzles 208 corresponds to a second water delivery function. Additionally, a third water delivery function is provided which uses both the first set of nozzles 206 and the second set of nozzles 208 simultaneously. A user can select between the first water delivery function, the second water delivery function and the third water delivery function using an actuator (not shown).

By integrating the first set of nozzles 206 and the second set of nozzles 208, the third water delivery function, which uses both sets of nozzles 206 and 208 simultaneously, is operable to discharge water in a more coherent and balanced manner resulting in an improved showering experience. For example, the distance (or spacing) between the first set of nozzles 206 and the second set of nozzles 208 is relatively small, such that the first set of nozzles 206 and the second set of nozzles 208 are integrated. Furthermore, the number of nozzles in each of the first set of nozzles 206 and the second set of nozzles 208, as well as a corresponding total cross-sectional area (i.e., flow area) of the openings of the first set of nozzles 206 and the second set of nozzles 208, can contribute to the integration of the first set of nozzles 206 and the second set of nozzles 208.

Figure 6:
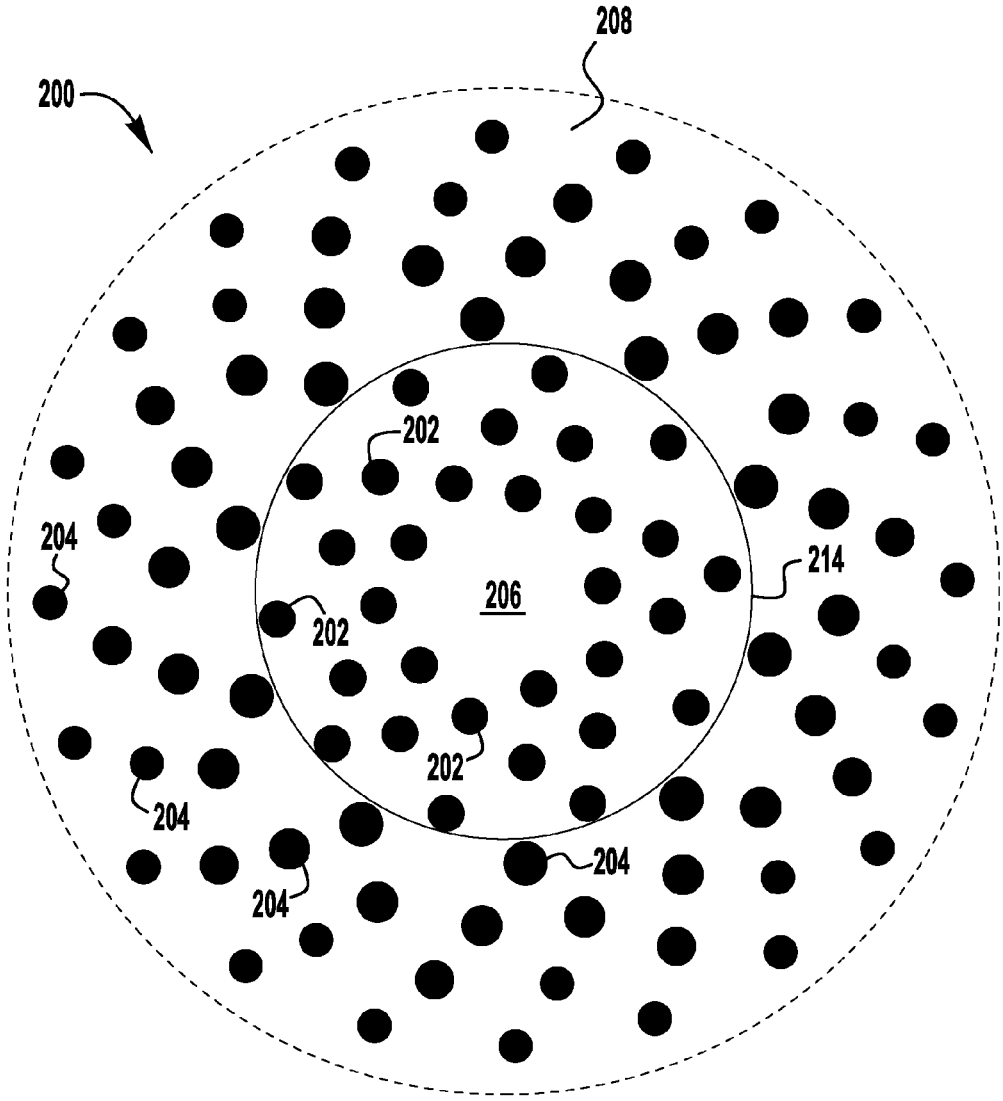
FIG. 6 is a diagram showing a nozzle arrangement supporting multiple functions according to another exemplary embodiment.
Figure 7:
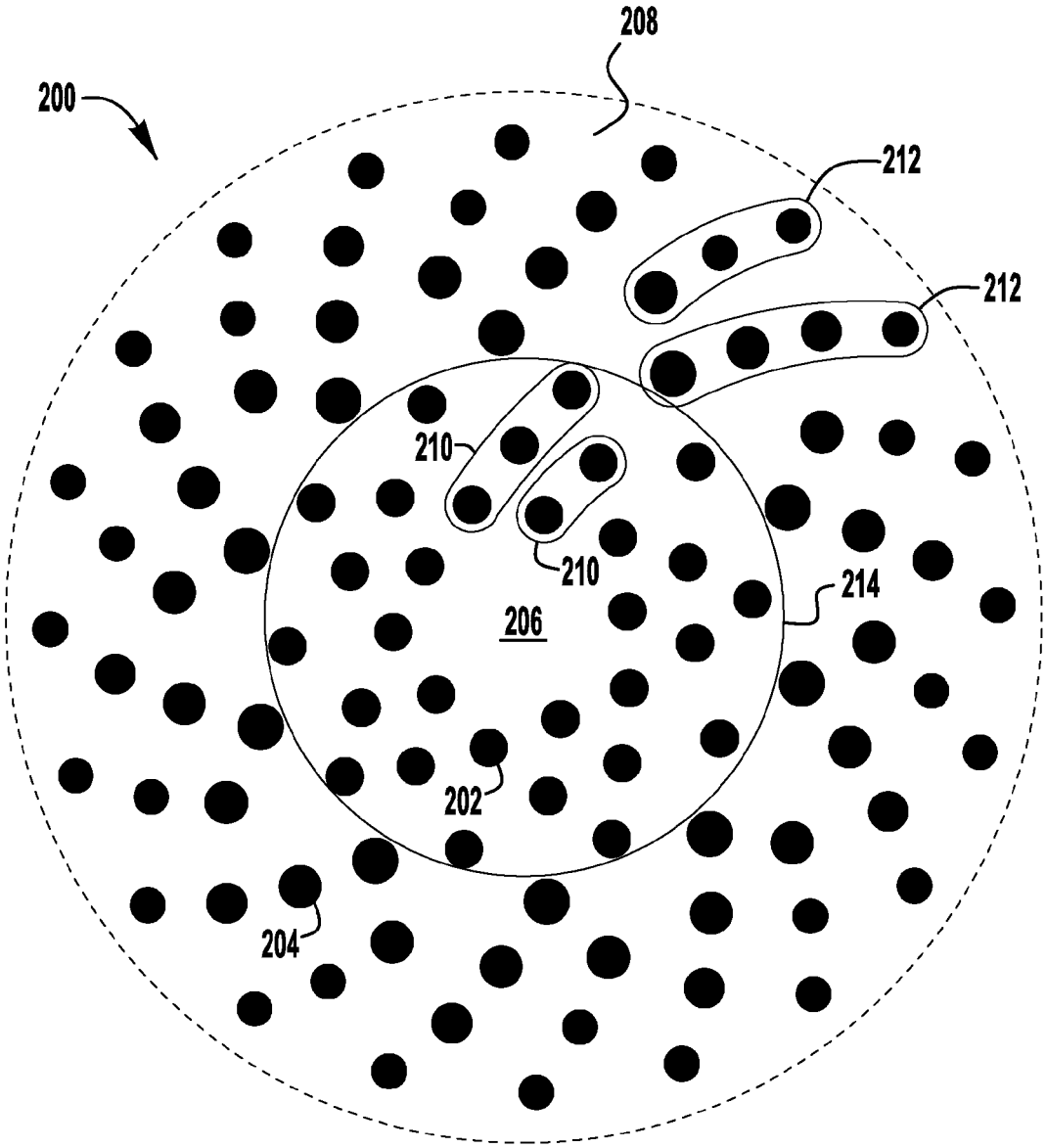
FIG. 7 is a diagram showing nozzle groupings forming exemplary first and second curves in the nozzle arrangement of FIG. 6.
Figure 8:
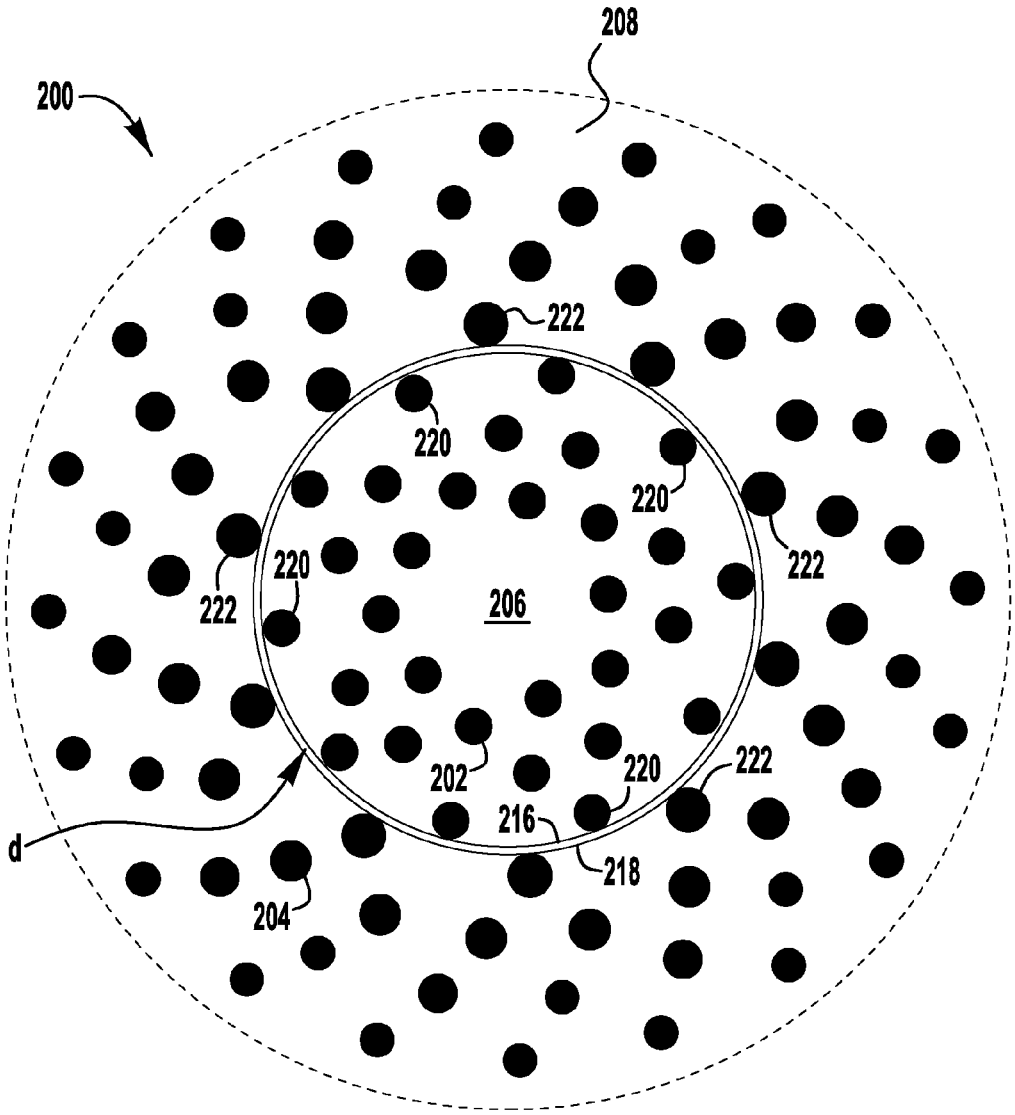
FIG. 8 is a diagram showing an exemplary radial gap in the nozzle arrangement of FIG. 6.

In one exemplary embodiment, the first set of nozzles 206 has at least 9 nozzles 202 and the second set of nozzles 208 has at least 9 nozzles 204. As shown in FIGS. 6-8, the nozzle arrangement 200 has 30 nozzles 202 in the first set of nozzles 206 and 70 nozzles 204 in the second set of nozzles 208. The nozzles 202 in the first set of nozzles 206 may or may not have the same dimensions. The nozzles 204 in the second set of nozzles 208 may or may not have the same dimensions. The nozzles 202, 204 in both the first set of nozzles 206 and the second set of nozzles 208 may or may not have the same dimensions.

In one exemplary embodiment, a diameter of an opening in each nozzle 202 in the first set of nozzles 206 is within 0.032 inches to 0.042 inches, inclusive. In another exemplary embodiment, a diameter of an opening in each nozzle 202 in the first set of nozzles 206 is within 0.036 inches to 0.046 inches, inclusive. In yet another exemplary embodiment, a diameter of an opening in each nozzle 202 in the first set of nozzles 206 is within 0.028 inches to 0.038 inches, inclusive. In still another exemplary embodiment, a diameter of an opening in each nozzle 202 in the first set of nozzles 206 is within 0.030 inches to 0.040 inches, inclusive.

In one exemplary embodiment, a diameter of an opening in each nozzle 202 in the first set of nozzles 206 is approximately equal to 0.034 inches. In another exemplary embodiment, a diameter of an opening in each nozzle 202 in the first set of nozzles 206 is approximately equal to 0.042 inches. In yet another exemplary embodiment, a diameter of an opening in each nozzle 202 in the first set of nozzles 206 is approximately equal to 0.030 inches. In still another exemplary embodiment, a diameter of an opening in each nozzle 202 in the first set of nozzles 206 is approximately equal to 0.040 inches.

In one exemplary embodiment, a diameter of an opening in each nozzle 204 in the second set of nozzles 208 is within 0.028 inches to 0.038 inches, inclusive. In another exemplary embodiment, a diameter of an opening in each nozzle 204 in the second set of nozzles 208 is within 0.020 inches to 0.032 inches, inclusive. In yet another exemplary embodiment, a diameter of an opening in each nozzle 204 in the second set of nozzles 208 is within 0.032 inches to 0.042 inches, inclusive. In still another exemplary embodiment, a diameter of an opening in each nozzle 204 in the second set of nozzles 208 is within 0.028 inches to 0.035 inches, inclusive.

In one exemplary embodiment, a diameter of an opening in each nozzle 204 in the second set of nozzles 208 is approximately equal to 0.034 inches. In another exemplary embodiment, a diameter of an opening in each nozzle 204 in the second set of nozzles 208 is approximately equal to 0.032 inches. In yet another exemplary embodiment, a diameter of an opening in each nozzle 204 in the second set of nozzles 208 is approximately equal to 0.038 inches. In still another exemplary embodiment, a diameter of an opening in each nozzle 204 in the second set of nozzles 208 is approximately equal to 0.035 inches.

In one exemplary embodiment, the first set of nozzles 206 has from 15 to 45 nozzles 202, inclusive, with a total cross-sectional area of the openings of the nozzles 206 being within 0.010 $in^2$ to 0.045 $in^2$, inclusive. In another exemplary embodiment, the first set of nozzles 206 has from 19 to 42 nozzles 202, inclusive, with a total cross-sectional area of the openings of the nozzles 206 being within 0.015 $in^2$ to 0.040 $in^2$, inclusive. In yet another exemplary embodiment, the first set of nozzles 206 has from 22 to 38 nozzles 202, inclusive, with a total cross-sectional area of the openings of the nozzles 206 being within 0.018 $in^2$ to 0.037 $in^2$, inclusive. In still another exemplary embodiment, the first set of nozzles 206 has from 24 to 36 nozzles 202, inclusive, with a total cross-sectional area of the openings of the nozzles 206 being within 0.019 $in^2$ to 0.041 $in^2$, inclusive.

In one exemplary embodiment, the first set of nozzles 206 has 24 nozzles 202 with a total cross-sectional area of the openings of the nozzles 206 being approximately 0.022 $in^2$. In another exemplary embodiment, the first set of nozzles 206 has 24 nozzles 202 with a total cross-sectional area of the openings of the nozzles 206 being approximately 0.033 $in^2$. In yet another exemplary embodiment, the first set of nozzles 206 has 36 nozzles 202 with a total cross-sectional area of the openings of the nozzles 206 being approximately 0.025 $in^2$. In still another exemplary embodiment, the first set of nozzles 206 has 30 nozzles 202 with a total cross-sectional area of the openings of the nozzles 206 being approximately 0.038 $in^2$.

In one exemplary embodiment, the second set of nozzles 208 has from 20 to 90 nozzles 204, inclusive, with a total cross-sectional area of the openings of the nozzles 208 being within 0.010 $in^2$ to 0.080 $in^2$, inclusive. In another exemplary embodiment, the second set of nozzles 208 has from 23 to 70 nozzles 204, inclusive, with a total cross-sectional area of the openings of the nozzles 208 being within 0.012 $in^2$ to 0.060 $in^2$, inclusive. In yet another exemplary embodiment, the second set of nozzles 208 has from 25 to 65 nozzles 204, inclusive, with a total cross-sectional area of the openings of the nozzles 208 being within 0.018 $in^2$ to 0.053 $in^2$, inclusive. In still another exemplary embodiment, the second set of nozzles 208 has from 27 to 70 nozzles 204, inclusive, with a total cross-sectional area of the openings of the nozzles 208 being within 0.020 $in^2$ to 0.067 $in^2$, inclusive.

In one exemplary embodiment, the second set of nozzles 208 has 36 nozzles 204 with a total cross-sectional area of the openings of the nozzles 208 being approximately 0.033 $in^2$. In another exemplary embodiment, the second set of nozzles 208 has 64 nozzles 204 with a total cross-sectional area of the openings of the nozzles 208 being approximately 0.051 $in^2$. In yet another exemplary embodiment, the second set of nozzles 208 has 27 nozzles 204 with a total cross-sectional area of the openings of the nozzles 208 being approximately 0.031 $in^2$. In still another exemplary embodiment, the second set of nozzles 208 has 70 nozzles 204 with a total cross-sectional area of the openings of the nozzles 208 being approximately 0.067 $in^2$.

The nozzle characteristics described herein (e.g., diameter of the openings and total cross-sectional area of the openings) are based on nozzles (e.g., nozzles 202 and 204) having substantially circular openings. It will be appreciated that the general inventive concept encompasses other nozzle types, including nozzles having non-circular openings. The equivalent nozzle characteristics of a nozzle having a non-circular opening can be readily determined.

As shown in FIG. 7, the first set of nozzles 206 includes a plurality of first curves 210 which are each formed from a plurality of adjacent nozzles 202. The second set of nozzles 208 includes a plurality of second curves 212 which are each formed from a plurality of adjacent nozzles 204. For purposes of illustration, the nozzles 206 forming a few of the first curves 210 and the nozzles 208 forming a few of the second curves 212 are surrounded by a geometric shape. As noted above, "curve" refers to a line connecting a set of points, wherein the points may be represented by openings of nozzles in a nozzle arrangement. For example, the points may be represented by the openings of the nozzles 202, 204 in the nozzle arrangement 200. The line may or may not be a straight line. The line may or may not have a constant rate of curvature. Accordingly, the first curves and/or the second curves can be linear or non-linear.

Each first curve 210 passes through a center of an opening in the plurality of nozzles forming the first curve 210. Each second curve 212 passes through a center of an opening in the plurality of nozzles forming the second curve 212. In one exemplary embodiment, at least one of the first curves 210 and the second curves 212 is formed from three or more nozzles 202 and 204, respectively.

As noted above, the first set of nozzles 206 and the second set of nozzles 208 are integrated. This means, for example, that the distance (or spacing) between an area encompassing the first set of nozzles 206 and an area encompassing the second set of nozzles 208 is relatively small. Furthermore, as noted above, the arrangement, number and/or size of the nozzles 202, 204 can be selected to facilitate the integration of the first set of nozzles 206 and the second set of nozzles 208.

The average distance (or spacing) between a center of an opening in each of the nozzles 202 in each of the first curves 210 is denoted as $a_{avg}$ and can be computed in a manner described above using Equation 1. Likewise, the average distance (or spacing) between a center of an opening in each of the nozzles 204 in each of the second curves 212 is denoted as $b_{avg}$ and can be computed in a manner described above using Equation 2.

A radial gap 214 separates the nozzles 202 in the first set of nozzles 206 from the nozzles 204 in the second set of nozzles 208. The radial gap 214 is represented by a solid line in FIGS. 6-7. In FIG. 8, the radial gap 214 is defined by the distance (or spacing) between a first circle 216 and a second circle 218. The distance (or spacing) corresponding to the radial gap 214 is denoted as d.

Figure 9:
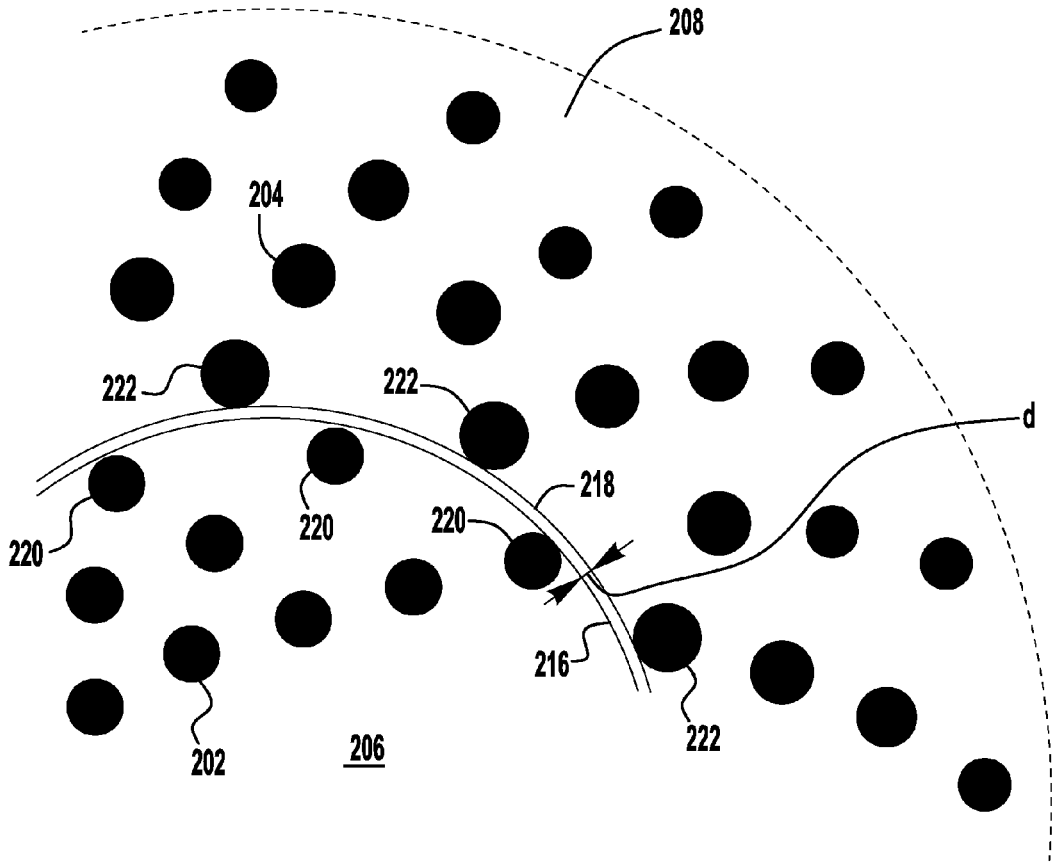
FIG. 9 is a diagram showing a close-up view of a portion of the nozzle arrangement of FIG. 8.

FIG. 9 shows a portion of the nozzle arrangement 200 shown in FIG. 8. In FIGS. 8-9, it can be seen that the first set of nozzles 206 includes a ring of nozzles 220 that are closest to the second set of nozzles 208. Likewise, the second set of nozzles 208 includes a ring of nozzles 222 that are closest to the first set of nozzles 206. In one exemplary embodiment, the first circle 216 borders the ring of nozzles 220 by being the smallest circle that can be drawn to encompass the first set of nozzles 206 without overlapping any of the nozzles 202 in the first set of nozzles 206. The second circle 218 borders the ring of nozzles 222 by being the largest circle that can be drawn to encompass the first set of nozzles 206 without overlapping any of the nozzles 204 in the second set of nozzles 208. In another exemplary embodiment, the first circle 216 runs through the center of openings of the nozzles 220 and the second circle 218 runs through the center of openings of the nozzles 222 (not shown).

As noted above, the nozzles 202 in the first set of nozzles 206 and the nozzles 204 in the second set of nozzles 208 are integrated. This means that the spacing between the first set of nozzles 206 and the second set of nozzles 208, i.e., the radial gap 214, is relatively small.

To ensure the integration of the first set of nozzles 206 and the second set of nozzles 208, the distance d is selected to satisfy the relationship shown in Equation 4. In Equation 4, the value x is a constant value that represents the magnitude of integration. In one exemplary embodiment, the value x is in the range of 2 to 5, inclusive. In Equation 4, min ($a_{avg}$, $b_{avg}$) means to substitute the smaller of the two values $a_{avg}$ and $b_{avg}$.

$$d \leq x^* \min(a_{avg}, b_{avg}) \quad \text{(Equation 4)}$$

For example, with a value of x equals 5, the spacing between the first set of nozzles 206 and the second set of nozzles 208 must be less than five times the smaller of the average spacing between the nozzles 202 of the first curves 210 in the first set of nozzles 206 and the average spacing between the nozzles 204 of the second curves 212 in the second set of nozzles 208. With a value of x equals 2, the spacing between the first set of nozzles 206 and the second set of nozzles 208 must be less than two times the smaller of the average spacing between the nozzles 202 of the first curves 210 in the first set of nozzles 206 and the average spacing between the nozzles 204 of the second curves 212 in the second set of nozzles 208. As the value of x decreases, the integration between the first set of nozzles 206 and the second set of nozzles 208 is maximized.

The above description of specific embodiments has been given by way of example. From the disclosure given, those skilled in the art will not only understand the general inventive concept and its attendant advantages, but will also find apparent various changes and modifications to the structures and methods disclosed. For example, although the above exemplary embodiments are directed to multi-function showerheads and nozzle arrangements that discharge water, the general inventive concept encompasses any multi-function apparatus for discharging any fluid. Furthermore, from the above disclosure, it should be obvious that three or more distinct sets of nozzles can be integrated. It is sought, therefore, to cover all such changes and modifications as fall within the spirit and scope of the general inventive concept, as defined by the appended claims and equivalents thereof.

What is claimed is:

1. A multi-function showerhead comprising a plurality of nozzles for discharging fluid according to at least three fluid delivery functions, wherein said plurality of nozzles includes a first set of nozzles disposed on a face of said showerhead and a second set of nozzles disposed on said face of said showerhead, wherein said first set of nozzles includes at least one nozzle closest to a center of said face, wherein said second set of nozzles includes at least one nozzle furthest from said center of said face, wherein a first fluid delivery function corresponds to discharging said fluid through only said first set of nozzles, wherein a second fluid delivery function corresponds to discharging said fluid through only said second set of nozzles, wherein a third fluid delivery function corresponds to discharging said fluid through said first set of nozzles and said second set of nozzles simultaneously, wherein said first set of nozzles includes a plurality of first curves, each of said first curves formed from a plurality of adjacent nozzles in said first set of nozzles, wherein said second set of nozzles includes a plurality of second curves, each of said second curves formed from a plurality of adjacent nozzles in said second set of nozzles, wherein each of said first curves includes a first nozzle defining a first end of said first curve and a second nozzle defining a second end of said first curve, said first nozzle being further from said center of said face than any other nozzle in said first curve, said second nozzle being closest to said center of said face than any other nozzle in said first curve, wherein each of said second curves includes a first nozzle defining a first end of said second curve and a second nozzle defining a second end of said second curve, said first nozzle being further from said center of said face than any other nozzle in said second curve, said second nozzle being closest to said center of said face than any other nozzle in said second curve, and wherein a plurality of said first curves are substantially integrated with a corresponding plurality of said second curves.

2. The multi-function showerhead of claim 1, wherein an average distance between centers of openings in said adjacent nozzles in said first set of nozzles forming said first curves is a first average spacing value, wherein an average distance between centers of openings in said adjacent nozzles in said second set of nozzles forming said second curves is a second average spacing value, and wherein a distance between each of said first curves and said corresponding second curves is less than or equal to 2 times the smaller of said first average spacing value and said second average spacing value.

3. The multi-function showerhead of claim 1, wherein an average distance between centers of openings in said adjacent nozzles in said first set of nozzles forming said first curves is a first average spacing value, wherein an average distance between centers of openings in said adjacent nozzles in said second set of nozzles forming said second curves is a second average spacing value, wherein a radial gap separates said first set of nozzles from said second set of nozzles, wherein said radial gap is devoid of any of said plurality of nozzles, and wherein a width of said radial gap is less than or equal to 2 times the smaller of said first average spacing value and said second average spacing value.

4. The multi-function showerhead of claim 3, wherein a width of said radial gap is measured from a center of a nozzle in said first set of nozzles furthest from said center of said face to a center of a nozzle in said second set of nozzles closest to said center of said face.

5. The multi-function showerhead of claim 3, wherein a width of said radial gap is measured from an edge of a nozzle in said first set of nozzles furthest from said center of said face to an edge of a nozzle in said second set of nozzles closest to said center of said face.

6. The multi-function showerhead of claim 1, wherein said first set of nozzles is enclosed by said second set of nozzles.

7. The multi-function showerhead of claim 1, wherein a number of nozzles in said second set of nozzles is greater than or equal to a number of nozzles in said first set of nozzles.

8. The multi-function showerhead of claim 1, wherein said first set of nozzles includes at least 9 nozzles, and wherein said second set of nozzles includes at least 9 nozzles.

9. The multi-function showerhead of claim 1, wherein at least one of said first curves and said second curves is formed from 3 or more adjacent nozzles.

10. The multi-function showerhead of claim 1, wherein a plurality of said first curves is formed from 3 or more adjacent nozzles, and wherein a plurality of said second curves is formed from 3 or more adjacent nozzles.

11. The multi-function showerhead of claim 1, wherein all of said nozzles in said first set of nozzles have the same dimensions.

12. The multi-function showerhead of claim 1, wherein all of said nozzles in said second set of nozzles have the same dimensions.

13. The multi-function showerhead of claim 1, wherein each nozzle in said first set of nozzles has an opening with a diameter within 0.028 inches to 0.046 inches, inclusive.

14. The multi-function showerhead of claim 1, wherein each nozzle in said second set of nozzles has an opening with a diameter within 0.020 inches to 0.042 inches, inclusive.

15. The multi-function showerhead of claim 1, wherein said first set of nozzles has 15 to 45 nozzles, inclusive.

16. The multi-function showerhead of claim 15, wherein said first set of nozzles has a total cross-sectional area within 0.010 $in^2$ to 0.045 $in^2$, inclusive.

17. The multi-function showerhead of claim 1, wherein said second set of nozzles has 20 to 90 nozzles, inclusive.

18. The multi-function showerhead of claim 17, wherein said second set of nozzles has a total cross-sectional area within 0.010 $in^2$ to 0.080 $in^2$, inclusive.

19. The multi-function showerhead of claim 1, wherein said plurality of nozzles includes a plurality of third curves, each of said third curves formed from one of said first curves and one of said second curves, and wherein each of said third curves includes a first nozzle defining a first end of said third curve and a second nozzle defining a second end of said third curve, said first nozzle being further from said center of said face than any other nozzle in said third curve, said second nozzle being closest to said center of said face than any other nozzle in said third curve.

20. A nozzle arrangement comprising a plurality of nozzles for discharging fluid according to at least three fluid delivery functions, wherein said plurality of nozzles includes a first set of nozzles and a second set of nozzles, wherein said first set of nozzles includes at least one nozzle closest to a center of said nozzle arrangement, wherein said second set of nozzles includes at least one nozzle furthest from said center of said nozzle arrangement, wherein a first fluid delivery function corresponds to discharging said fluid through only said first set of nozzles, wherein a second fluid delivery function corresponds to discharging said fluid through only said second set of nozzles, wherein a third fluid delivery function corresponds to discharging said fluid through said first set of nozzles and said second set of nozzles simultaneously, wherein said first set of nozzles includes a plurality of first curves, each of said first curves formed from a plurality of adjacent nozzles in said first set of nozzles, wherein said second set of nozzles includes a plurality of second curves, each of said second curves formed from a plurality of adjacent nozzles in said second set of nozzles, wherein each of said first curves includes a first nozzle defining a first end of said first curve and a second nozzle defining a second end of said first curve, said first nozzle being further from said center of said face than any other nozzle in said first curve, said second nozzle being closest to said center of said face than any other nozzle in said first curve, wherein each of said second curves includes a first nozzle defining a first end of said second curve and a second nozzle defining a second end of said second curve, said first nozzle being further from said center of said face than any other nozzle in said second curve, said second nozzle being closest to said center of said face than any other nozzle in said second curve, and wherein a plurality of said first curves are substantially integrated with a corresponding plurality of said second curves.

21. The nozzle arrangement of claim 20, wherein an average distance between centers of openings in said adjacent nozzles in said first set of nozzles forming said first curves is a first average spacing value, wherein an average distance between centers of openings in said adjacent nozzles in said second set of nozzles forming said second curves is a second average spacing value, and wherein a distance between each of said first curves and said corresponding second curves is less than or equal to 2 times the smaller of said first average spacing value and said second average spacing value.

22. The nozzle arrangement of claim 20, wherein an average distance between centers of openings in said adjacent nozzles in said first set of nozzles forming said first curves is a first average spacing value, wherein an average distance between centers of openings in said adjacent nozzles in said second set of nozzles forming said second curves is a second average spacing value, wherein a radial gap separates said first set of nozzles from said second set of nozzles, wherein said radial gap is devoid of any of said plurality of nozzles, and wherein a width of said radial gap is less than or equal to 2 times the smaller of said first average spacing value and said second average spacing value.

23. The nozzle arrangement of claim 20, wherein said plurality of nozzles includes a plurality of third curves, each of said third curves formed from one of said first curves and one of said second curves, and wherein each of said third curves includes a first nozzle defining a first end of said third curve and a second nozzle defining a second end of said third curve, said first nozzle being further from said center of said face than any other nozzle in said third curve, said second nozzle being closest to said center of said face than any other nozzle in said third curve.

* * * * *